US012727660B2

(12) United States Patent
Timura et al.

(10) Patent No.: US 12,727,660 B2
(45) Date of Patent: Sep. 8, 2026

(54) SHAVING BRUSH

(71) Applicant: TRIAXIS MACHINE & TOOL, LLC, North Royalton, OH (US)

(72) Inventors: Jeremiah Timura, Strongsville, OH (US); Douglas Timura, Medina, OH (US); Nicholas TImura, Medina, OH (US); Matthew Timura, North Olmsted, OH (US); Mark Timura, West Salem, OH (US)

(73) Assignee: TRIAXIS MACHINE & TOOL, LLC, North Royalton, OH (US)

( * ) Notice: Subject to any disclaimer, the term of this patent is extended or adjusted under 35 U.S.C. 154(b) by 579 days.

(21) Appl. No.: 18/143,377

(22) Filed: May 4, 2023

(65) Prior Publication Data

US 2024/0365962 A1 Nov. 7, 2024

(51) Int. Cl.

| | |
|---|---|
| ***A46B 7/04*** | (2006.01) |
| ***A46B 5/00*** | (2006.01) |
| ***A46B 5/02*** | (2006.01) |
| *A45D 34/04* | (2006.01) |
| *A46B 9/10* | (2006.01) |

(52) U.S. Cl.

CPC ..... *A46B 5/0095* (2013.01); *A46B 5/02* (2013.01); *A46B 7/04* (2013.01); *A45D 34/04* (2013.01); *A46B 9/10* (2013.01); *A46B 2200/1033* (2013.01)

(58) Field of Classification Search

CPC ..... A46B 9/10; A46B 9/02; A46B 5/0095; A46B 7/04; A45D 34/04

See application file for complete search history.

(56) References Cited

U.S. PATENT DOCUMENTS

| | | | | |
|---|---|---|---|---|
| 1,546,288 | A * | 7/1925 | Larsson | A46B 11/0027 401/175 |
| 1,956,927 | A * | 5/1934 | Pietro | A46B 15/00 401/172 |
| 4,248,543 | A * | 2/1981 | Carrington | A46B 11/0041 401/269 |
| 8,230,543 | B2 * | 7/2012 | Shrier | A46B 7/04 15/176.1 |
| 9,320,349 | B2 * | 4/2016 | Hwang | A46B 7/026 |
| 11,363,872 | B1 | 6/2022 | Lydiard | |
| 12,193,564 | B2 * | 1/2025 | Hwang | A46B 5/0095 |
| 2002/0148058 | A1 * | 10/2002 | Greenwood | A46B 7/04 15/176.1 |
| 2017/0224098 | A1 * | 8/2017 | Jones | A46B 9/021 |
| 2018/0344006 | A1 * | 12/2018 | Tarling | B01F 33/254 |

FOREIGN PATENT DOCUMENTS

| | | | | |
|---|---|---|---|---|
| GB | 2187085 | A * | 9/1987 | A46B 17/04 |

* cited by examiner

*Primary Examiner* — Michael D Jennings
(74) *Attorney, Agent, or Firm* — Lippes Mathias LLP

(57) ABSTRACT

A shaving brush is disclosed that can accommodate brush knots having different diameters. The brush comprises a handle, a collet, and a collar, among other components. The collet includes an upper end which includes a bore with an inner diameter for accommodating a brush knot of a given diameter. The collet also includes a lower end which fits into the handle. The collar fits over the collet and engages the handle, to trap the collet in place. Different collets have bores with different inner diameters, but the collets all have the same outer diameter. Brush knots with different diameters are thus used with a given collet, and all collets can be used with the same brush handle.

19 Claims, 8 Drawing Sheets

SHAVING BRUSH

BACKGROUND

The present disclosure relates to shaving brushes. In particular, the handle of the shaving brush is adapted to be able to accommodate brush knots of different diameters.

A shaving brush is conventionally used to apply shaving cream, soaps, etc. to the face of a user. The knot of a shaving brush is the hair (natural or synthetic) or bristled end portion of the brush. The brush knot is typically permanently attached to a brush handle using glue or other adhesive. Depending on the end user, a different size, density, configuration, etc. of the brush knot may be desired. As a result, multiple different brushes are needed when different brush knot diameters are desired. This may occur, for example, due to personal preference, a desire to have more control versus the ability to cover more area more quickly, different applications, sharing between different users, etc.

BRIEF DESCRIPTION

The present disclosure relates to a shaving brush having a handle which can accommodate brush knots having different diameters. As a result, a single brush handle can be used interchangeably with a number of different brush knots. In this regard, the knot is inserted into an upper end of a collet, and the lower end of the collet is inserted into the handle and held in place by a collar. Different collets have bores with a different diameter adapted to hold a knot, but all collets have the same outer diameter.

Some embodiments thus relate to shaving brushes that comprise a handle, a first collet, and a collar. The handle has an open upper end. The first collet has an upper end and a lower end, the lower end being adapted to fit in the open upper end of the handle, and the upper end including a bore with a first inner diameter. The collar is adapted to engage the handle and retain the first collet, and to expose the bore of the first collet.

In some embodiments, the shaving brush further comprises a bushing within the open upper end of the handle that is adapted to engage the first collet. The bushing can be made of a rubber, plastic, polymeric, or other elastic material.

In some embodiments, the upper end of the handle further includes an external thread for engaging the collar. The handle can also further include an o-ring below the external thread. The handle may include a weighted lower end. The handle can be made of a metal, plastic, wood, ceramic, or marble, or any other suitable material.

In some embodiments, the first inner diameter of the bore of the first collet is from about 20 mm to about 30 mm. In particular embodiments, the upper end of the first collet is angled inwards from a central portion at an upper angle measured longitudinally, and the lower end of the first collet is angled inwards from the central portion at a lower angle measured longitudinally, and the upper angle is less than the lower angle. The upper end of the first collet may include an end surface that is visible when the collar engages the handle. Sometimes, the lower end of the first collet further includes a lower bore. The first collet can be made of a rubber or other elastic material.

In additional embodiments, an interior surface of an upper end of the collar includes an angled surface that engages the upper end of the first collet. The collar can also include an internal thread for engaging the handle.

The shaving brush may further comprise a first knot which is affixed within the bore of the first collar.

In other embodiments, the shaving brush further comprises a second collet having an upper end and a lower end, the lower end being adapted to fit in the open upper end of the handle, and the upper end including a bore with a second inner diameter. The first inner diameter of the first collet is different from the second inner diameter of the second collet. An outer diameter of the upper end of the first collet and an outer diameter of the upper end of the second collet are substantially equal. Both the first collet and the second collet can be retained between the handle and the collar.

Also disclosed are methods for switching or changing between a first knot having a first diameter and a second knot having a second different diameter on a shaving brush, comprising: separating a collar from a brush handle to expose a first collet upon which the first knot is inserted; removing the first collet from an open upper end of the brush handle; inserting a second collet upon which the second knot is inserted into the open upper end of the brush handle; and re-engaging the collar to the brush handle to retain the second collet with the second knot.

Generally, the first collet and the second collet have identical exterior shapes, but have bores on their upper ends with different diameters. The first collet and the second collet may each be made of a rubber or other elastic material. The handle can include a bushing within the open upper end.

These and other non-limiting aspects and/or objects of the disclosure are more particularly described below.

BRIEF DESCRIPTION OF THE DRAWINGS

The following is a brief description of the drawings, which are presented for the purposes of illustrating embodiments disclosed herein and not for the purposes of limiting the same.

FIG. 4A is a transparent side exterior view. FIG. 4B is a plan view. FIG. 4C is a side cross-sectional view through line A-A of FIG. 4B.

FIG. 5A is a transparent side exterior view. FIG. 5B is a plan view. FIG. 5C is a side cross-sectional view through line B-B of FIG. 5B.

FIG. 6A is a transparent side exterior view. FIG. 6B is a plan view. FIG. 6C is a side cross-sectional view through line C-C of FIG. 6B.

FIG. 7A is a transparent side exterior view. FIG. 7B is a plan view. FIG. 7C is a side cross-sectional view through line D-D of FIG. 7B.

DETAILED DESCRIPTION

Figure 1:
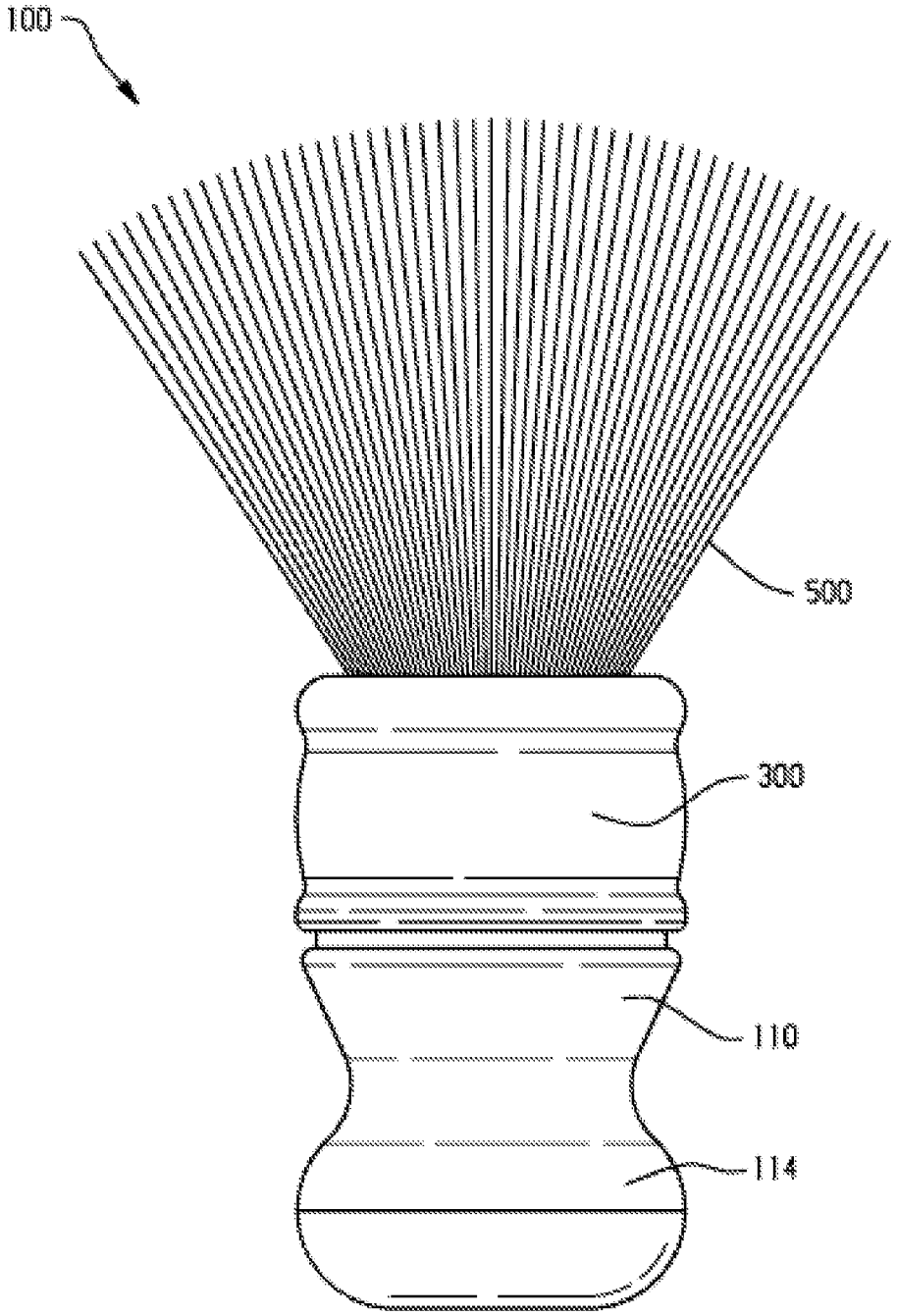
FIG. 1 is an exterior side view of the fully assembled shaving brush.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Numerical values in the specification and claims of this application should be understood to include numerical values which are the same when reduced to the same number of significant figures and numerical values which differ from the stated value by less than the experimental error of conventional measurement technique of the type described in the present application to determine the value. All ranges disclosed herein are inclusive of the recited endpoint.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4." The term "about" may refer to plus or minus 10% of the indicated number.

Spatially relative terms, such as "beneath," "below," "lower," "above," "upper" and the like, may be used herein for ease of description to describe the relationship between two elements or features as illustrated in the figures. These terms are intended to encompass different orientations of the device in use or operation in addition to the orientation depicted in the figures. For example, the device may be rotated 90 degrees or at other orientations) and the spatially relative terms used herein should be interpreted accordingly.

The present disclosure relates to shaving brushes which can be used with brush knots of different diameters. The shaving brush includes a handle, one or more collets, and a collar. Optionally, a bushing may be present in the handle. One or more interchangeable or replacement brush knots may also be included.

FIG. 1 is an exterior side view of the fully assembled shaving brush. As visible here, the brush 100 includes a handle 110, a collar 300, and a brush knot 500. The portion of the handle covered by the collar may be considered the upper end of the handle (not visible here). The portion of the handle not covered by the collar may be considered the lower end 114 of the handle. It is noted that the brush knot is generally fixed in place, and is not able to rotate or move up-and-down in any manner.

Figure 2:
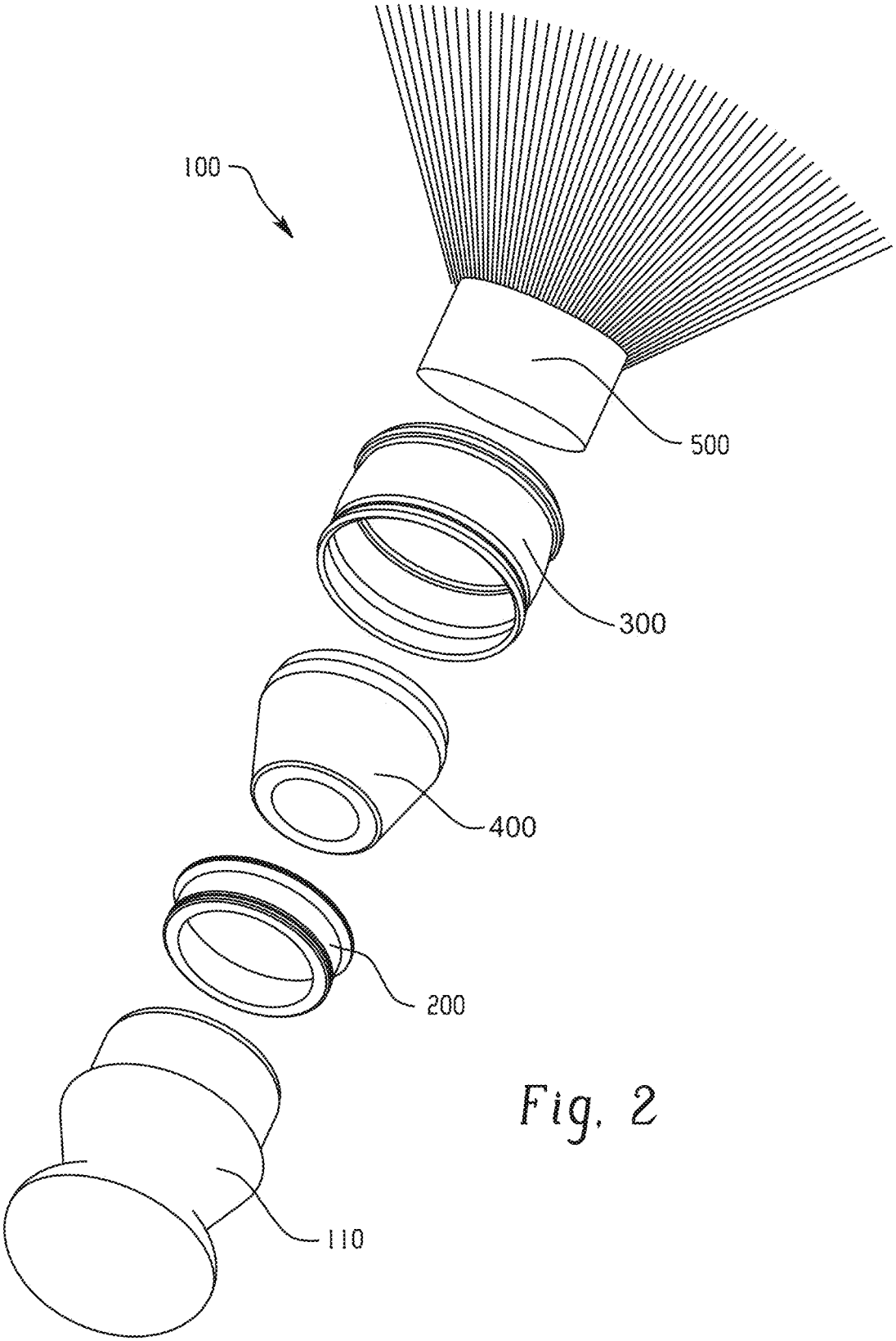
FIG. 2 is an exploded perspective view of the shaving brush, showing a brush knot, a collar, a collet, a bushing, and the handle.

FIG. 2 is an exploded perspective view of the shaving brush 100, showing the brush knot 500, a collar 300, a collet 400, a bushing 200, and the handle 110. It is noted the bushing is optional, but usually desirable to have.

Figure 3:
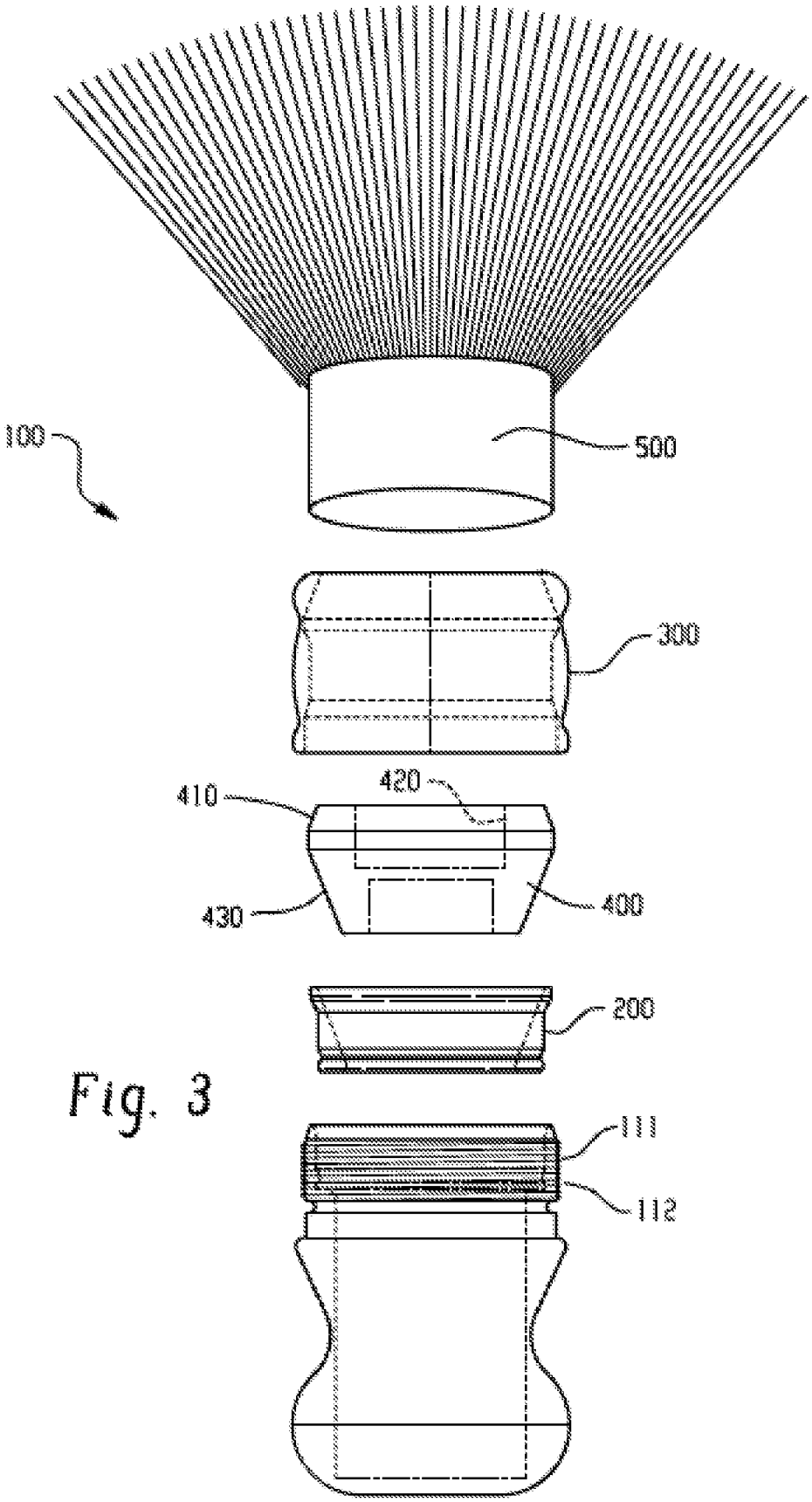
FIG. 3 is an exploded semi-transparent side view of the shaving brush.

FIG. 3 is an exploded semi-transparent side view of the shaving brush. As can be seen here, the bushing 200 will fit within the upper end 112 of the handle. The bushing 200 is located between the sidewall 111 of the handle and a collet 400. The brush knot 500 is inserted into a cylindrical bore 420 in the upper end 410 of the collet 400. The lower end 430 of the collet is inserted into the bushing 200. The collar 300 will engage the handle 110, and will retain the collet 400 between them.

Figure 4C:
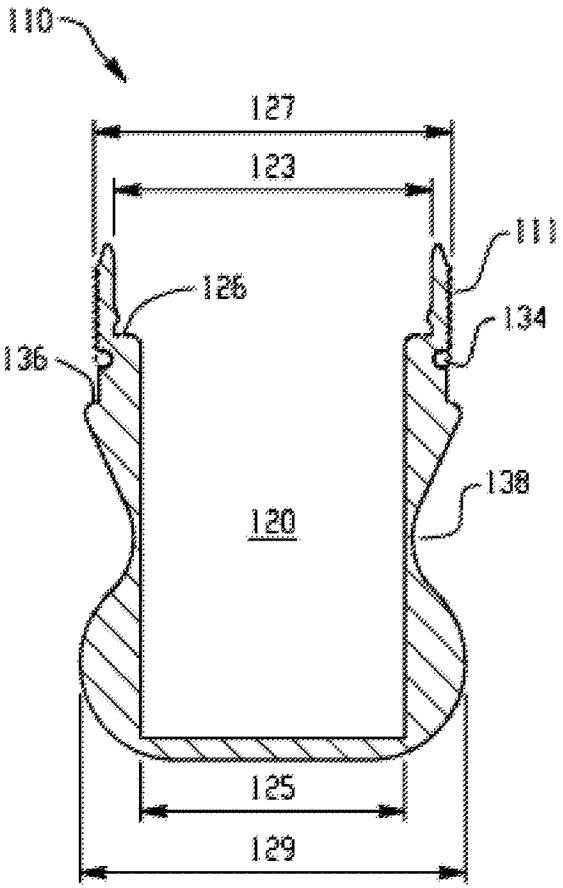
FIGS. 4A-4C are different views of the handle.
Figure 4B:
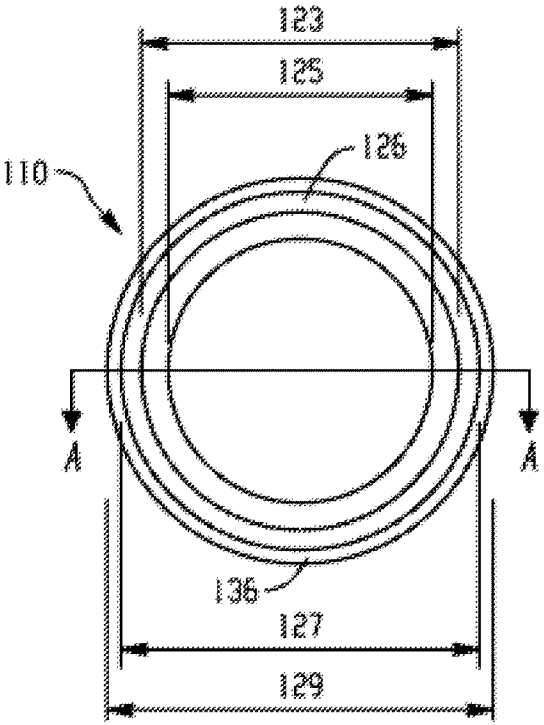
Figure 4A:
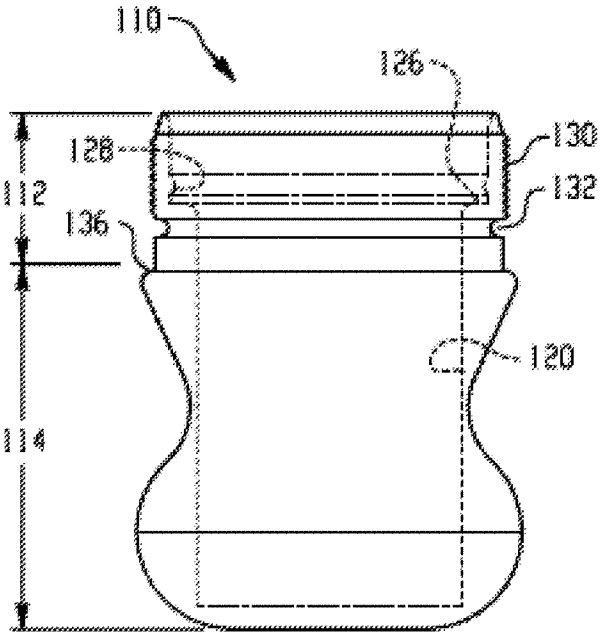

FIGS. 4A-4C are different views of the handle. FIG. 4A is a transparent side exterior view. FIG. 4B is a plan view. FIG. 4C is a side cross-sectional view through line A-A of FIG. 4B.

The handle 110 has an upper end 112 and a lower end 114. The upper end 112 is open, or in other words a cylindrical bore 120 extends inward into the handle from the upper end. As best seen in FIG. 4C, the bore may have a first inner diameter 123 proximate the opening at the upper end, and a second inner diameter 125 further within the handle 110. The first inner diameter 123 is greater than the second inner diameter 125. The transition between the two inner diameters is abrupt, and forms an internal stop surface 126. The upper end of the handle also includes an internal tongue 128 extending from the sidewall, near the internal stop surface 126.

The upper end 112 of the handle is adapted to engage the collar 300, such that the collet will be retained or fixed in place between the handle 110 and the collar 300. For example, the upper end of the handle may include an external thread 130, which will engage an internal thread on the collar. Alternatively, other joining mechanisms which fix the collar in place relative to the handle can be used. The upper end 112 thus has an outer diameter 127.

In some embodiments, the upper end may also include an external groove 132 located below the external thread 130, or in other words closer to the center of the handle than the external thread. An o-ring 134 (shown in FIG. 4C) may be placed within this groove for increasing water resistance or penetration when the collar engages the handle. An external stop surface 136 is present, and indicates where the collar is fully engaged with the handle. The stop surface may also act as the threshold between the upper end 112 and the lower end 114 of the handle. The lower end 114 has an outer diameter 129, which is greater than the upper end outer diameter 127.

Referring to FIG. 4B, the handle lower end outer diameter 129, the upper end outer diameter 127, the bore first inner diameter 123, and the bore second inner diameter 125 are visible. As can also be seen here, the handle 110 and the overall brush generally have a cylindrical/circular shape. Other configurations are also possible. The two stop surfaces 126, 136 are also labeled.

The lower end 114 of the handle may include a tapered groove 138, for comfortable holding of the handle. The lower end may also be weighted (i.e. heavier) compared to the upper end 112. In comparison to the upper end 112, the lower end 114 is closed off. In some embodiments, the bore 120 does not extend all the way through the handle. In other embodiments not illustrated here, the bore can extend all the way through the handle, and the lower end is covered with a cap. The handle is sized to comfortably fit within a human hand, and in some embodiments has a height of about two (2) inches measured along its longitudinal axis.

Figure 5A:
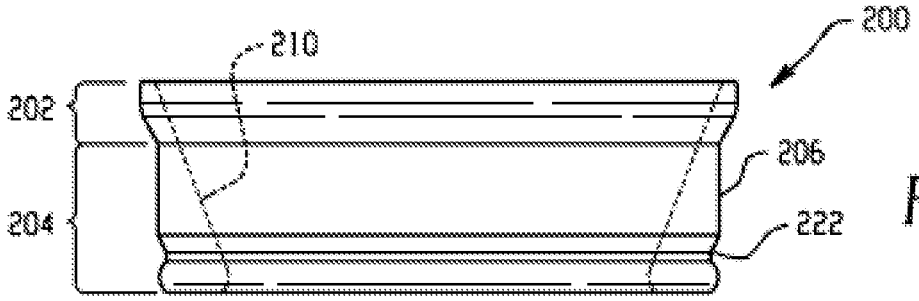
FIGS. 5A-5C are different views of the bushing.
Figure 5B:
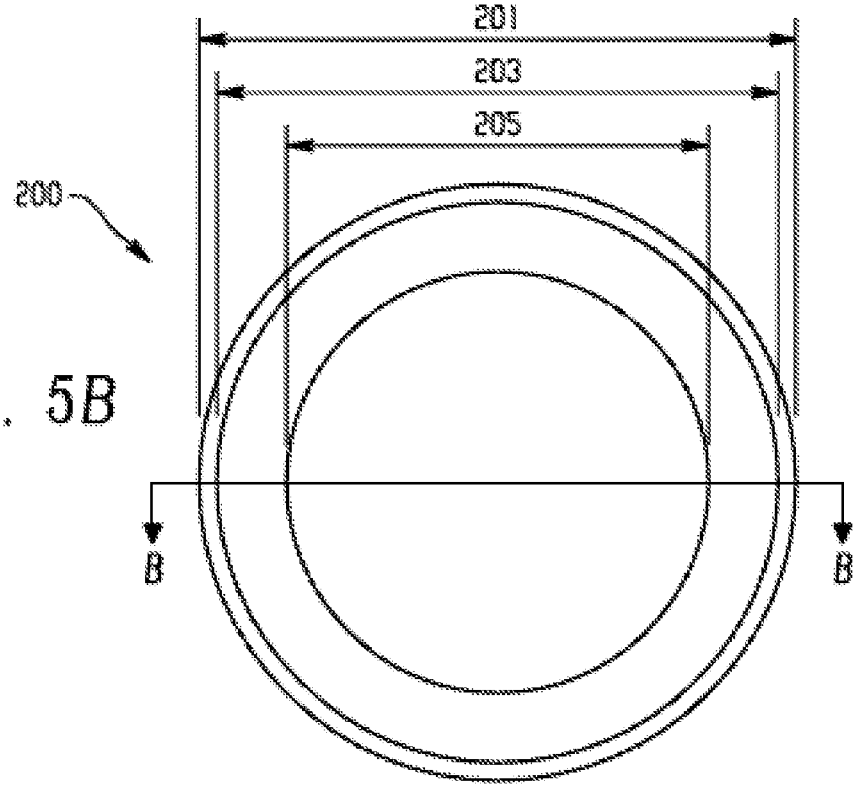
Figure 5C:
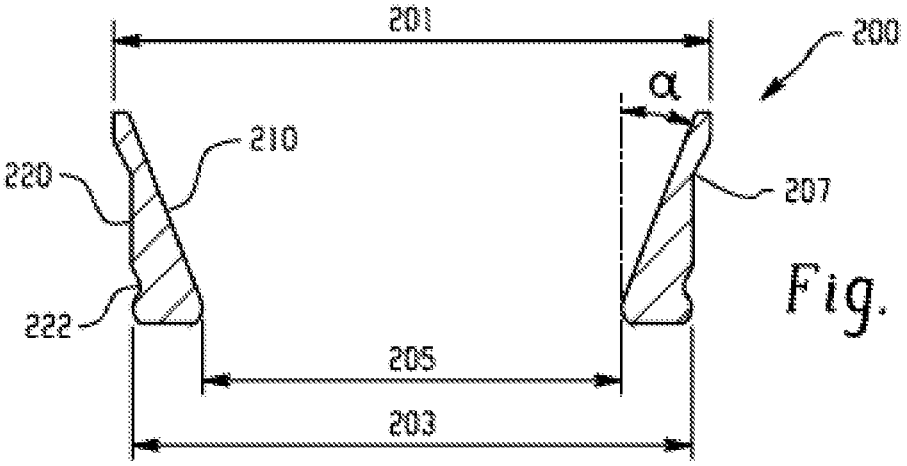

FIGS. 5A-5C are different views of the bushing. FIG. 5A is a transparent side exterior view. FIG. 5B is a plan view. FIG. 5C is a side cross-sectional view through line B-B of FIG. 5B.

When present, the bushing 200 is used as a bearing surface between the handle 110 and the collet 400. The bushing may be described as being formed from a shaped tubular sidewall 206. The bushing also has an upper end 202 and a lower end 204. The interior surface 210 of the bushing sidewall is angled (or conical). When measured relative to a vertical line running parallel to the longitudinal axis of the bushing, the angle α of the interior surface may be from about 15° to about 50°.

The exterior surface 220 of the lower end 204 of the sidewall is substantially parallel to the longitudinal axis of the bushing. An external groove 222 may be present on the exterior surface at the lower end of the sidewall. Referring back to FIG. 4C, the lower end 204 of the bushing engages the upper end 112 of the handle in the volume having the first inner diameter 123, and the internal tongue 128 of the handle engages the external groove 222 of the bushing. The upper end 202 of the bushing extends over the upper end 112 of the handle, and receives the collet.

Referring to FIG. 5B and FIG. 5C, then, the bushing upper end outer diameter 201, the lower end outer diameter 203, and the lower end inner diameter 205 are visible. Also marked is the transition point 207 between the upper end and the lower end.

As illustrated here, the upper end 202 and the lower end 204 of the bushing are both open. However, it is contemplated the lower end of the bushing could be closed off with a surface if desired.

Figure 6A:
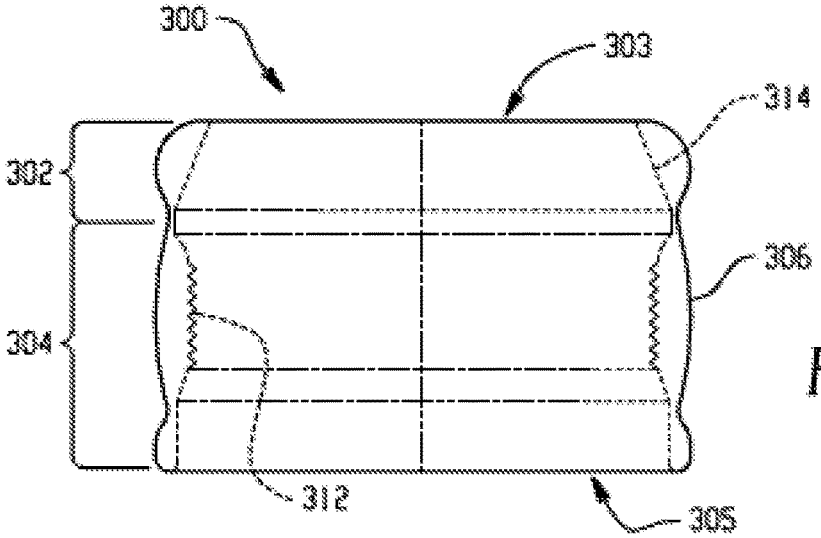
FIGS. 6A-6C are different views of the collar.
Figure 6B:
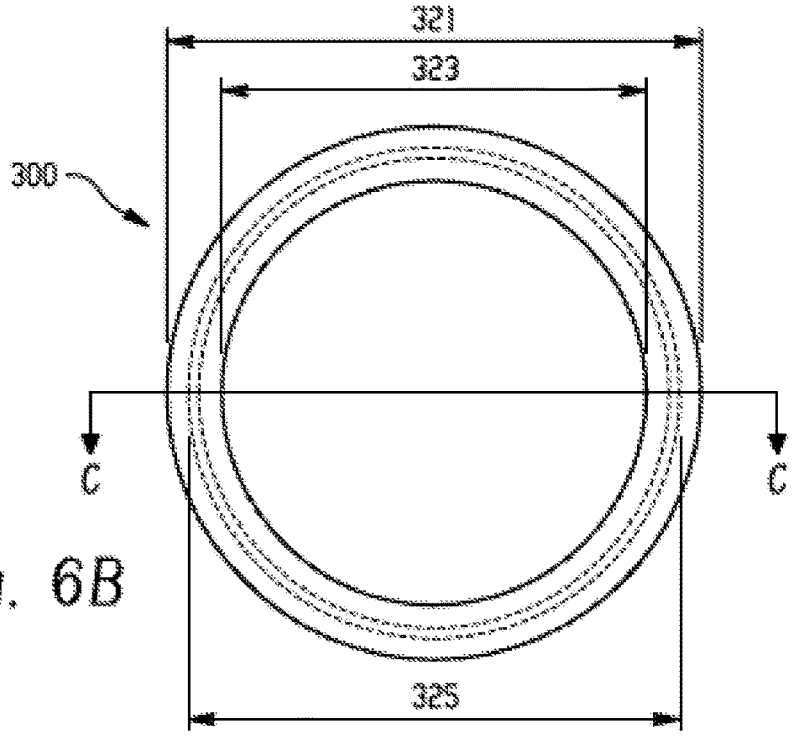
Figure 6C:
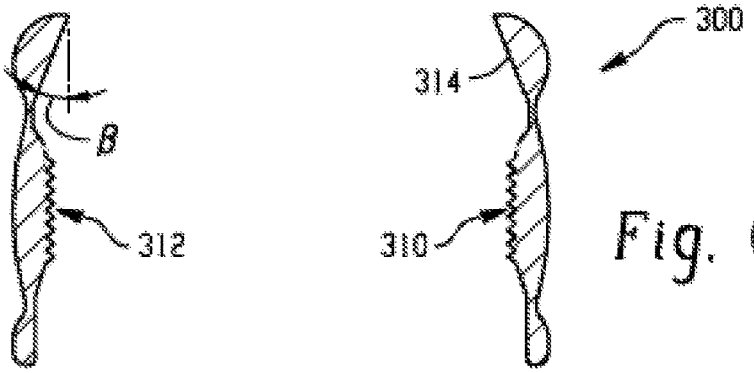

FIGS. 6A-6C are different views of the collar. FIG. 6A is a transparent side exterior view. FIG. 6B is a plan view. FIG. 6C is a side cross-sectional view through line C-C of FIG. 6B.

The collar 300 may be described as being formed from a shaped tubular sidewall 306. The collar 300 has an upper end 302 and a lower end 304, both of which are open. Put another way, there is a hole 303 in the upper end 302 and a hole 305 in the lower end 304. The collar can also be considered to have a cylindrical bore which is surrounded by the sidewall 306. The collar is adapted to engage the handle and to expose the bore of the first collet (which holds the brush knot).

The lower end 304 of the collar may be considered to be that portion of the collar which overlaps with the upper end 112 of the handle. The lower end 304 is adapted to engage the handle. For example, the interior surface 310 of the collar may include an internal thread 312 on a lower end of the collar, which will engage the external thread 130 on the handle. Alternatively, the collar and handle will have complementary joining mechanisms which fix the collar in place relative to the handle, such as snap-fit joints having a rocker arm and a complementary slot.

The interior surface at the upper end of the collar is a conical or angled surface 314. When measured relative to a vertical line running parallel to the longitudinal axis of the bushing, the angle β of the angled surface may be from about 15° to about 50°. The angled surface 314 of the collar will engage the collet.

Referring to FIG. 6B, the collar has an outer diameter 321 which is about equal to the handle lower end outer diameter 129. The upper end of the collar has an upper end inner diameter 323, and the lower end of the collar has a lower end inner diameter 325.

Figure 7A:
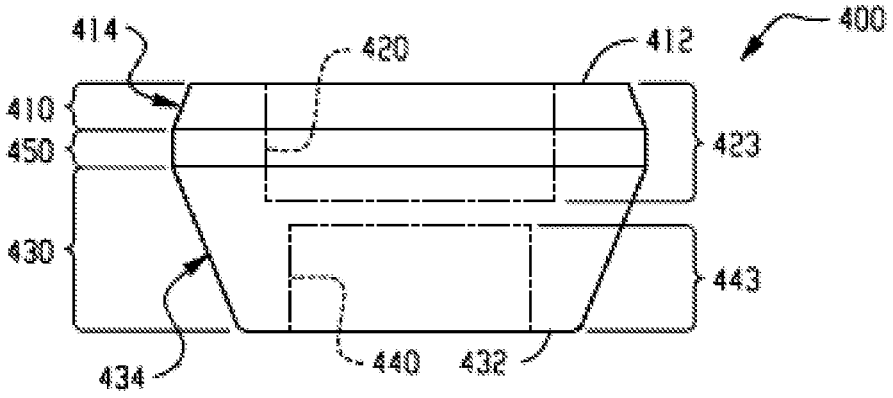
FIGS. 7A-7C are different views of a first collet.
Figure 7B:
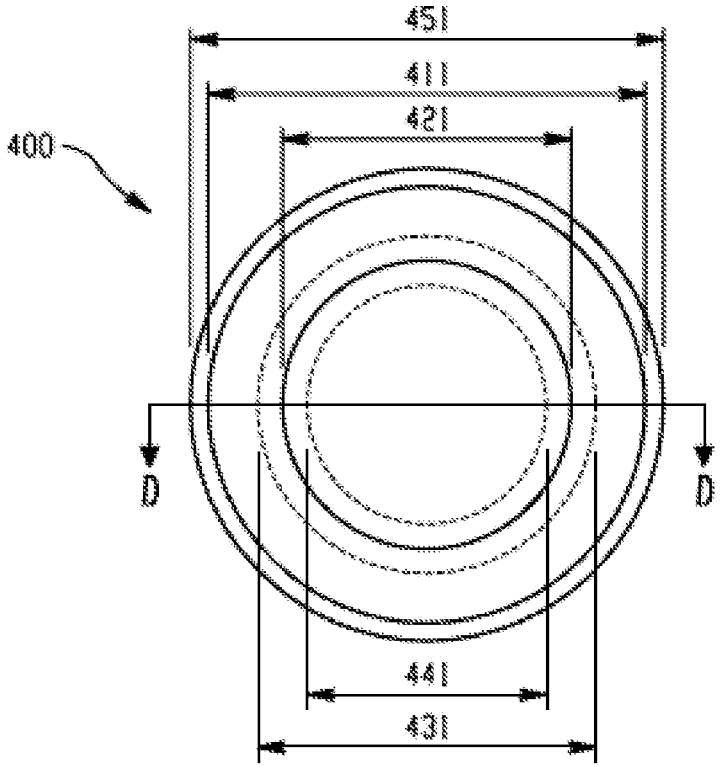
Figure 7C:
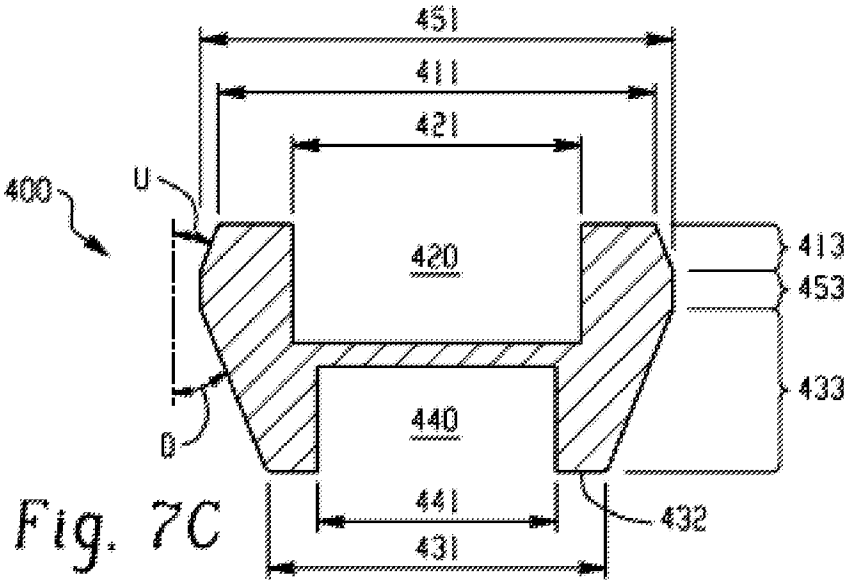

FIGS. 7A-7C are different views of a first collet. FIG. 7A is a transparent side exterior view. FIG. 7B is a plan view. FIG. 7C is a side cross-sectional view through line D-D of FIG. 7B.

The collet 400 acts as an interface between the brush knot 500 and the handle 110. The first collet 400 has an upper end 410 and a lower end 430, and a central portion 450 between the two ends. The upper end has an upper end surface 412. An upper end bore 420 extends into the first collet from the upper end surface. The bore has an inner diameter 421. In particular embodiments, the inner diameter of the cylindrical bore is from about 20 mm to about 30 mm, which matches the diameters of brush knots that can be used with the shaving brush. The upper end surface has an outer diameter 411, which is greater than the inner diameter 421 of the bore. The bore has a depth 423, and is illustrated here as extending through the central portion 450 and into the lower end 430.

The lower end has a lower end surface 432 having an outer diameter 431. Generally speaking, the lower end of the collet is adapted to fit in the open upper end 112 of the handle, and also into the upper end 202 of the bushing 200 when it is used. In some embodiments, a lower end bore 440 extends into the first collet from the lower end surface. The lower end bore has an inner diameter 441, which is less than the outer diameter 431 of the lower end surface. The lower end bore has a depth 443. The presence of the lower end bore is optional, and is usually present to reduce the amount of material needed to make the first collet. In particular embodiments, the lower end bore inner diameter 441 is less than the upper end bore inner diameter 421.

It is noted that some material usually remains between the upper end bore 420 and the lower end bore 440. Put another way, the height of the first collet is the sum of the heights 413, 453, 433 of the upper end, the central portion, and the lower end, respectively. The sum of the upper end bore depth 423 and the lower end bore depth 443 is less than the height of the first collet. It is also noted that the height 413 of the upper end is usually less than the height 433 of the lower end.

Continuing, the central portion also has an outer diameter 451. The central portion outer diameter 451 is greater than the upper end surface outer diameter 411. The central portion outer diameter 451 is also greater than the lower end surface outer diameter 431. The upper end surface outer diameter 411 is also greater than the lower end surface outer diameter 431.

Referring to FIG. 7B, the central portion outer diameter 451, the upper end surface outer diameter 411, and the upper end bore inner diameter 421 are shown in solid line. The lower end surface outer diameter 431 and the lower end bore inner diameter 441 are shown in dashed line.

The exterior surface 414 at the upper end of the first collet is angled inwards relative to the central portion 450, or in other words is a conical surface. When measured relative to a vertical line running parallel to the longitudinal axis of the bushing, the angle U of the upper angled surface may be from about 15° to about 50°. Similarly, the exterior surface 434 at the lower end of the first collet is angled inwards relative to the central portion 450, i.e. is also conical. When measured relative to a vertical line running parallel to the longitudinal axis of the bushing, the angle D of the lower angled surface may be from about 15° to about 50°. In particular embodiments, the angle D is greater than the angle U.

Figure 8:
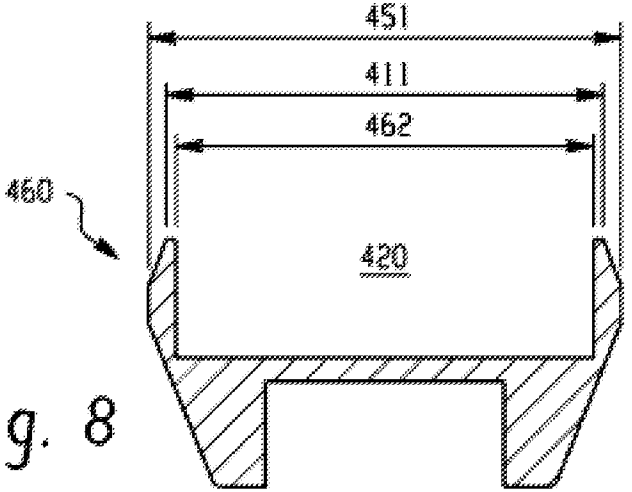
FIG. 8 is a side cross-sectional view of a second collet, also taken through line D-D of FIG. 7B.

FIG. 8 is a cross-sectional side view of a second collet 460, also through line D-D of FIG. 7B. The second collet 460 is substantially identical to the first collet 400 in all ways except that the inner diameter 462 of the upper end bore 420 is different.

Figure 9:
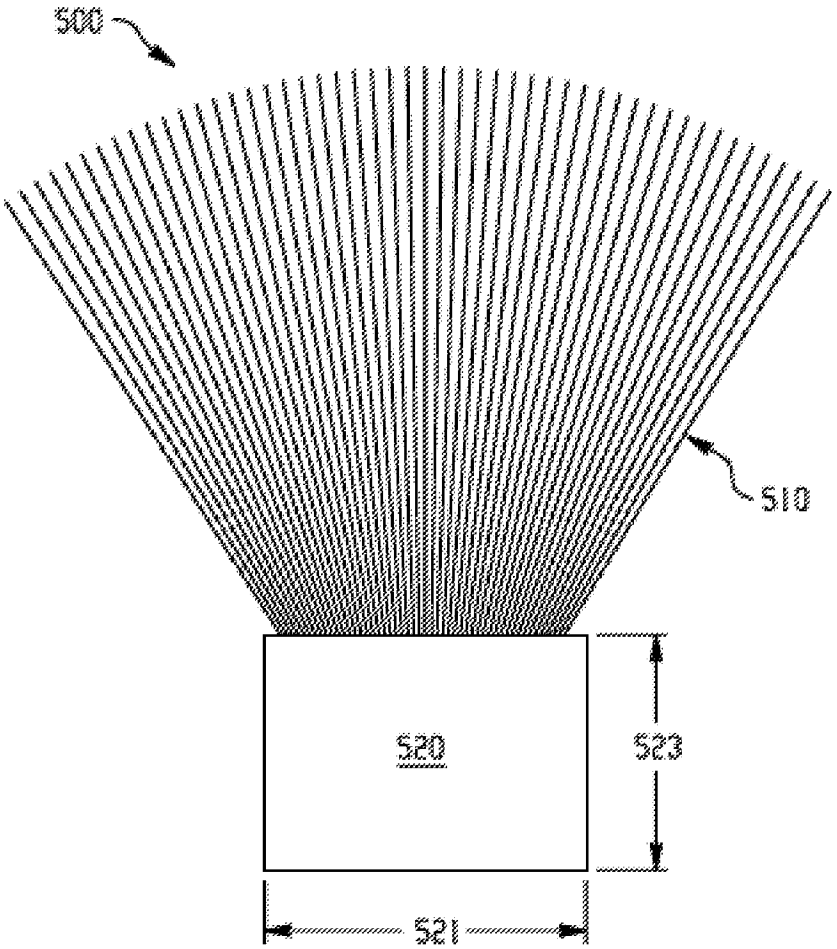
FIG. 9 is a side view of a brush knot.

FIG. 9 is a side view of a brush knot. The brush knot 500 is formed from bristles 510 which are joined together at a base 520, for example by adhesive or other means. The base has a diameter 521, which is about equal to the inner diameter 421 of the upper end bore of a collet and can be inserted therein. In particular embodiments, the inner diameter of the bore is from about 20 mm to about 30 mm. The base also has a height 523, which desirably is equal to or less than the depth 423 of the upper end bore of a collet.

Now referring back to FIG. 2, the brush knot 500 may first be inserted into the upper end bore 420 of the collet 400, and then held together tightly while the collar 300 is slipped over the bristles. Alternatively, the collar 300 may be placed between the brush knot 500 and the collet 400, and the base 520 of the knot is then inserted into the upper end bore of the collet. The collet 400 can then be placed into the open upper end 112 of the handle 110, where it contacts the bushing 200. The collet is then locked into place by joining the collar 300 and the handle 110 together. The outer diameter 411 of the upper end surface 412 of the collet is less than the upper end inner diameter 323 of the collar, and as a result the upper end surface 412 of the collet can be visible in the assembled brush. It is noted that the exterior surfaces of the collar and the handle are not required to be cylindrical. For example, the collar and the lower end of the handle and the collar could have a façade of any shape, so long as they include cylindrical bores that can engage the collet and bushing.

Referring now to FIGS. 5A-7C, it should be noted that the lower end 430 of the collet 400 has the same angle as the interior surface 210 of the bushing. Put another way, the angle D has about the same value as angle $\alpha$. Similarly, the angle $\beta$ of the angled surface 314 at the upper end of the collar has about the same value as angle U of the upper end 410 of the collet 400. As a result, when the collar is tightened, the upper end of the collet is pushed radially inwards towards the base 520 of the knot by the angled surface 314 of the collar, which "pinches" to hold the knot in place through high static friction. Put another way, the bore inner diameter 421 is slightly reduced, squeezing the knot. The knot does not need to be permanently attached to the collet using adhesive or other means, the pinching action is sufficient to hold the knot without permitting it to rotate or otherwise move. If the angle U is improperly selected, the rubber material may instead be pushed upwards such that it squeezes out of the upper end hole 303 of the collar, which would reduce the pinching force.

The shaving brush can be used with brush knots of different diameters by selecting an appropriate collet having an upper end bore that matches the diameter of the brush knot and inserting the collet and brush knot between the handle and the collar. Put another way, two separate collets would generally have identical exterior shapes and their upper end would have the same outer diameter, but they would have upper end bores with different inner diameters. Any number of collets could be used with a single brush handle, with each collet having a different upper end bore inner diameter. Thus, the need for multiple different brushes for each knot diameter is addressed.

The user can switch between a first knot having a first diameter and a second knot having a second different diameter by separating the collar from the brush handle to expose a first collet upon which the first knot is inserted. The first collet is removed from the brush handle. A second collet holding the second knot is inserted into the open upper end of the brush handle. Finally, the collar re-engages the brush handle to retain the second collet with the second knot.

The various components of the shaving brush may be made using conventional manufacturing processes.

The handle and the collar are usually made of the same material, which may be made of any desired material. In some embodiments, the handle is made of a metal, plastic, or wood. For example, the handle could be made of anodized aluminum or steel. Suitable plastics could include, for example, acrylates, polycarbonates, polyethylene, polypropylene, polyethylene terephthalate (PET), polyvinyl chloride (PVC), acrylonitrile-butadiene-styrene (ABS), or vinyl resins. The bushing is made of a rubber or plastic material as desired. The collet is made of a soft rubber and should have shape memory, i.e. the ability to return to its original shape after a load has been applied. The use of rubber for the collet also aids in the making the handle watertight. The brush knot may be made of any suitable natural or synthetic product, such as boar, horse, or badger.

The present disclosure has been described with reference to example embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A shaving brush, comprising:

a handle with an open upper end that includes an external thread;

a bushing within the open upper end of the handle;

a first collet having an upper end and a lower end, the lower end being adapted to fit in the bushing, and the upper end including a bore with a first inner diameter;

a collar adapted to engage the handle and retain the first collet between the handle and the collar, and to expose the bore of the first collet, wherein the collar includes an internal thread for engaging the external thread of the handle; and a first brush knot that can be inserted into the bore of the first collet.

2. The shaving brush of claim 1, wherein the bushing is made of a rubber, plastic, or elastic material.

3. The shaving brush of claim 1, wherein an upper end inner diameter of the collar is less than a lower end inner diameter of the collar.

4. The shaving brush of claim 1, wherein the handle further includes an o-ring below the external thread.

5. The shaving brush of claim 1, wherein the handle includes a weighted lower end.

6. The shaving brush of claim 1, wherein the handle is made of a metal, plastic, wood, ceramic, or marble.

7. The shaving brush of claim 1, wherein the first inner diameter of the bore of the first collet is from about 20 mm to about 30 mm.

8. The shaving brush of claim 1, wherein the upper end of the first collet is angled inwards from a central portion at an upper angle measured longitudinally, and wherein the lower end of the first collet is angled inwards from the central portion at a lower angle measured longitudinally, the upper angle being less than the lower angle.

9. The shaving brush of claim 1, wherein the upper end of the first collet includes an end surface that is visible when the collar engages the handle.

10. The shaving brush of claim 1, wherein the lower end of the first collet further includes a lower bore.

11. The shaving brush of claim 1, wherein the first collet is made of an elastic material.

12. The shaving brush of claim 1, wherein an interior surface of an upper end of the collar includes an angled surface that engages the upper end of the first collet.

13. The shaving brush of claim 1, wherein the bushing includes an external groove that engages an internal tongue of the handle.

14. The shaving brush of claim 1, further comprising:

a second collet having an upper end and a lower end, the lower end being adapted to fit in the open upper end of the handle, and the upper end including a bore with a second inner diameter;

wherein the first inner diameter of the first collet is different from the second inner diameter of the second collet; and wherein an outer diameter of the upper end of the first collet and an outer diameter of the upper end of the second collet are substantially equal; and wherein both the first collet and the second collet can be retained between the handle and the collar.

15. A shaving brush, comprising:

a handle with an open upper end that includes an external thread;

a bushing within the open upper end of the handle;

a first collet having an upper end and a lower end, wherein the lower end is inserted into the bushing, and the upper end including a bore with a first inner diameter; and a collar adapted to engage the handle and retain the first collet between the handle and the collar, and to expose the bore of the first collet, wherein the collar includes an internal thread for engaging the external thread of the handle.

16. A method for switching between a first brush knot having a first diameter and a second brush knot having a second different diameter on a shaving brush, comprising:

separating a collar from a brush handle to expose a first collet upon which the first brush knot is inserted;

removing the first collet from an open upper end of the brush handle;

inserting a second collet upon which the second brush knot is inserted into the open upper end of the brush handle; and re-engaging the collar to the brush handle to retain the second collet with the second brush knot.

17. The method of claim 16, wherein the first collet and the second collet have identical exterior shapes, but have bores on their upper ends with different diameters.

18. The method of claim 16, wherein the first collet and the second collet are each made of a rubber or elastic material.

19. The method of claim 16, wherein the handle includes a bushing within the open upper end.

* * * * *